US009380886B2

(12) United States Patent
Rahni

(10) Patent No.: US 9,380,886 B2
(45) Date of Patent: Jul. 5, 2016

(54) WEARABLE CARRIER

(76) Inventor: Kari Rahni, Long Beach, CA (US)

( * ) Notice: Subject to any disclaimer, the term of this patent is extended or adjusted under 35 U.S.C. 154(b) by 529 days.

(21) Appl. No.: 13/433,913

(22) Filed: Mar. 29, 2012

(65) Prior Publication Data

US 2012/0248159 A1 Oct. 4, 2012

Related U.S. Application Data

(60) Provisional application No. 61/468,957, filed on Mar. 29, 2011.

(51) Int. Cl.
*A47D 13/02* (2006.01)

(52) U.S. Cl.
CPC ..... *A47D 13/02* (2013.01); *Y10T 29/49826* (2015.01)

(58) Field of Classification Search
CPC ..... A47D 13/02; A47D 13/025
USPC ..... 224/158, 160
See application file for complete search history.

(56) References Cited

U.S. PATENT DOCUMENTS

| | | | | | |
|---|---|---|---|---|---|
| D247,199 | S | * | 2/1978 | Carter | D3/214 |
| 4,333,591 | A | | 6/1982 | Case | |
| 4,785,984 | A | * | 11/1988 | Seitz-Gangemi | 224/259 |
| 5,016,797 | A | * | 5/1991 | Rowledge | 224/257 |
| 5,490,620 | A | * | 2/1996 | Bergqvist | 224/160 |
| 5,927,576 | A | * | 7/1999 | Nielsen | 224/161 |
| 5,950,887 | A | * | 9/1999 | Powell | A47D 13/025 224/158 |
| 5,954,254 | A | * | 9/1999 | Maeng | 224/645 |
| 6,065,655 | A | * | 5/2000 | Parewick | 224/158 |
| 6,595,396 | B2 | | 7/2003 | Cummings et al. | |
| 6,598,771 | B2 | * | 7/2003 | Norman | 224/160 |
| 6,976,614 | B1 | * | 12/2005 | Caramanis | 224/255 |
| 6,988,644 | B1 | * | 1/2006 | Asherbranner | 224/160 |
| 7,070,076 | B2 | * | 7/2006 | Bergkvist | 224/160 |
| 7,178,632 | B2 | * | 2/2007 | Casebolt et al. | 182/3 |
| D614,861 | S | * | 5/2010 | Smyth et al. | D3/213 |
| 7,780,049 | B1 | * | 8/2010 | Baranoski | 224/250 |
| D630,838 | S | * | 1/2011 | Gmeiner | D3/214 |
| D672,546 | S | * | 12/2012 | Dror et al. | D3/214 |
| 2005/0077330 | A1 | * | 4/2005 | Fernandez | 224/160 |
| 2005/0279791 | A1 | * | 12/2005 | Komorowski | 224/260 |
| 2007/0278264 | A1 | * | 12/2007 | Chesal et al. | 224/160 |
| 2009/0026235 | A1 | * | 1/2009 | Gray | 224/160 |
| 2009/0101683 | A1 | * | 4/2009 | Gilboa et al. | 224/160 |
| 2011/0163136 | A1 | * | 7/2011 | Billingham | 224/160 |
| 2012/0160885 | A1 | * | 6/2012 | Larch | A47D 13/025 224/158 |
| 2012/0199619 | A1 | * | 8/2012 | Zack | 224/160 |
| 2012/0286002 | A1 | * | 11/2012 | Dardel et al. | 224/159 |

FOREIGN PATENT DOCUMENTS

| | | | |
|---|---|---|---|
| JP | 2007111092 A | * | 5/2007 |
| NL | 1006025 C1 | | 6/1997 |

* cited by examiner

*Primary Examiner* — Brian D Nash
(74) *Attorney, Agent, or Firm* — KPPB LLP

(57) ABSTRACT

A baby carrier to be worn by multiple parents or caregivers, and method of using such a carrier is provided. It is cross between a traditional wrap and an adjustable ring sling with an additional adjustable connecting device at the user's back. It is constructed of two adjustable loops of fabric coupled by a connecting device at the user's back. It has the advantages of using a variety of positions as with a traditional wrap and the convenience of an adjustable ring sling that can stay in the user's appropriate size without the disadvantage of rewrapping for each use.

20 Claims, 4 Drawing Sheets

WEARABLE CARRIER

CROSS-REFERENCE TO RELATED APPLICATION

The current application claims priority to U.S. Provisional Application No. 61/468,957, filed Mar. 29, 2011.

FIELD OF THE INVENTION

The current invention is directed to a baby carrier; and more particularly to a baby ring wrap carrier.

BACKGROUND OF THE INVENTION

In the womb, babies are warm, snug, and never alone. It only makes sense that they would prefer the same type of environment after they're born.

Baby-wearing is a practice that allows parents to hold their babies close while keeping both arms free to get their grown-up tasks done at the same time. Not only does it involve "wearing" baby in a soft carrier, but it also requires a shift in mindset about baby care. Rather than picking up the baby to soothe, change, or feed, just to be put down again, baby-wearing means the baby spends the majority of her time close to the caregiver's body, and is put down for diaper changes, long naps, or when the caregiver needs more freedom of movement.

Below are four reasons to wear your baby:

Less crying. A scientific study of almost 100 mom-baby pairs found that babies who spent more time in carriers cried 43% less than babies who spent more time out-of-arms, More learning. While the caregiver is bustling about, the baby is busy absorbing and learning from his ever-changing environment. The baby sees, hears, and smells the world, and experiences the caregiver's reactions to it. All this stimulation helps the brain develop.

More comforting. The heartbeat, motion, breathing rhythms, and voice of the caregiver all remind baby of life inside the womb.

Stronger attachment. In an experimental study at Columbia University, more babies who were worn by their mothers in soft baby carriers developed secure attachments to their mothers than babies who were carried in infant seats.

A baby carrier should be adjustable to the changing physical conditions of the baby. Most baby slings are outgrown by 3-9 months. A carrier should adjust to you and your baby's needs.

There are a variety of carriers on the market today. They fall into the following categories:

Structured front and back carriers;
Hip carriers;
Slings;
Wraps; and
Others

Structured front and back carriers such as the BabyBjorn™, allow the user to carry a child on the front or back of the user's torso in a vertical inward or outward facing position. Structured back carriers, such as the one described in U.S. Pat. No. 4,333,591, allow the user to carry a child on the user's back in a vertical position facing the user's back. Some structured back carriers are essentially backpacks with compartment or seat in which the child is placed. They have straps that go over the user's shoulders.

There are numerous disadvantages to structured front and back carriers. First, the fabric is often hard canvas like, and bulky, which is not comfortable for the user or the child. It also makes it difficult to carry around or store. The bulky fabric also creates a wide area of fabric in between the child's legs. Studies have shown that during the early stages of children's development, when their joints are forming and developing, young children, especially those with low muscle tone, can be adversely affected by carriers that place their legs too far apart. Secondly, these types of carriers have limited positions, only vertical carrying positions. These are typically for toddlers or older children who can sit up unassisted and do not accommodate infants and young children. Third, the straps are not comfortable on the user's shoulders and/or back. And lastly, most structured carriers employ hardware such as snaps, buckles, zippers, clasps, or other plastic or metal connecting devices, which make putting a child in and out of the carrier complicated.

Hip carriers such as The Hiphugger™, U.S. Pat. No. 6,595,396, are typically made up of straps or material that fall over one of the user's shoulders, forming a sling-like pouch or seat for the child to sit in at the user's hip, with the child's weight on the user's hip, and the child's legs straddling both sides of the user's hip. Some hip carriers employ devices to adjust the length of the straps or material, and to adjust the width or tightness of the pouch-like seat. Some also include an additional strap, which encircles the users' waist.

Hip carriers have the following disadvantages. First, they only provide one seat-like position at the user's hip. It does not provide vertical inward or outward facing positions at the user's torso, which allow the child to snuggle against the user's body or to face outward at the front of the user's body. Secondly, they too, are for older children who can sit up unassisted; they are not suitable for infants. Third, hip carriers go over only one of the user's shoulders, with no kind of back support, placing the weight load solely on the user's shoulders, thereby resulting in neck and/or shoulder pain.

Sling carriers are typically a loop of fabric that falls across one's shoulder and under the opposite arm. Some slings are simply made by tying the ends of a long piece of fabric to form a loop. Others employ a device to attach the two ends of fabric together to form a loop. Some slings have the ends attached together for form a non-adjustable loop of fabric. Slings have the same disadvantages as the hip carriers in addition to insufficient security for infants or children. The child is merely cradled in one piece of fabric and can easily fall or slip out of the fabric, especially when user bends over. Older children can jump or push themselves out of the carrier.

Wraps are typically a long rectangular piece of fabric that is wrapped and tied around the user and the infant or child to create a variety of positions. There are also some wraps, such as The Ultimate Baby Carrier™, that employ rings, buckles, or other connecting device on one end to secure the ends in place rather than tying them in a knot. While wraps offer a variety of carrying positions, including cradle, semi-cradle, vertical front and back positions, and hip carry, they have the following disadvantages. First, wraps are difficult and complicated to put on and take off. Second, although wraps can be wrapped around the user to cross at the user's back, there is no device or means for easily adjusting the cross of the fabric up or down for optimal back support and comfort fit by the user.

Other carriers, which do not fall squarely into one of the above categories, include one described in Netherlands Pat. No. 1,006,025, the My Baby Nest Carrier™, the Loopi™ and the Baby K'tan™. All of these carriers are comprised of two loops of fabric either sewn through the other loop thereby intertwining the two loops, or simply comprised of two separate loops of fabric, which are left separate or held together by a connecting device. The My Baby Nest™, the Loopi™ and the Baby K'tan™ also have a separate sash that ties around the user and the child. These carriers have the following disadvantages. First, they are not adjustable for various sized users. Second, although the My Baby Nest Carrier™, the Loopi™ and the Baby K'tan™ include a sash, each are made too narrow and do not provide a sufficient amount of fabric to go securely around the child. They also provide little to no lower back support to the user.

Another carrier that falls into this category is the Close Baby Carrier™ from the UK. It is comprised of two pieces of fabric, which are sewn together in the back to form an X at the users back and front. It has two sets of rings on either side in which each end of fabric is fed through creating a small tail on each side that ties at the front of the waist. It then has a separate sash that ties around the user and the child and knots at the user's waist in the back. Although the Close Baby Carrier™ does adjust to different users, it has the same disadvantage of insufficient lower back support as the sash only ties at the users back instead of wrapping around the lower back and tying in the front. Also, the position of the X in the back and the rings on either side are not adjustable to the user's comfort and restricts the number of positions that can be used.

Accordingly, a need exists for an improved carrier that is simple, effective, and adjustable to a wide-variety of users.

SUMMARY OF THE INVENTION

The current invention is directed to a wearable carrier that is versatile in along the user to use a variety of carrying positions while providing multiple users with optimum comfort and back support.

In some embodiments, the inventions is directed to a carrier for babies and small animals configured to be worn by a user, the carrier including:

two carrier strips, each formed from a longitudinally elongated length of material having a first end and a second end, the second end having a loop forming interconnection disposed thereon, wherein the first end engages with and passes through the loop forming interconnection such that the strip forms a loop defined by the portion of the strip proximal to the loop forming interconnection and a tail of material defined by the portion of the strip that has passed through and is distal to the loop forming interconnection;

a loop interconnecting member configured to slidably interconnect the two carrier strips along the circumference of the loops formed from the carrier strips;

wherein the loop forming interconnection releasably secures the elongated length of the carrier strip such that the strip may be secured within the loop forming interconnection anywhere along its elongated length or released to move lengthwise through the loop forming interconnection such that the circumference of the loop and the length of the tail formed from the engagement between said loop forming interconnection and said elongated length of material may be adjusted;

wherein the loop interconnecting member releasably secures the two carrier strips together such that the point along the two carrier strips of the interconnection between the two carrier strips may be adjusted; and wherein the length of the carrier strips is chosen such that the tails formed from the strips are sufficiently long to allow each of the tails to wrap at least half-way about the circumference of the body of the user.

In one such embodiment, the carrier strips are made from a material selected from the group consisting of textiles and plastics.

In another such embodiment, the carrier strips are made from a natural or synthetic textile formed by a method selected from the group consisting of weaving, knitting, pressing and felting.

In still another such embodiment, the loop forming interconnection is a pair of rings.

In yet another such embodiment, the loop interconnecting member interconnects the two strips at an approximately vertically opposite angle.

In still yet another such embodiment, the loop interconnecting member is selected from the group consisting of a bisected circular or polygonical ring formed of a rigid material.

In still yet another such embodiment, the loop interconnecting member is a loop of flexible or rigid material.

In still yet another such embodiment, the loop interconnecting member is a square of flexible or rigid material having two bisecting passages, the passages set at a vertically opposite angle from each other.

In still yet another such embodiment, the loop interconnecting member further comprises an adjustment pull attached thereto.

In still yet another such embodiment, the strips are sufficiently long to allow each of the tails to wrap completely about the circumference of the body of the user.

In other embodiments, the invention is also directed to a method of carrying a baby or small animal using a wearable carrier comprising:

providing two carrier strips, each formed from a longitudinally elongated length of material having a first end and a second end, the second end having a loop forming interconnection disposed thereon, passing the first end through the loop forming interconnection such that the strip forms a loop defined by the portion of the strip proximal to the loop forming interconnection and a tail of material defined by the portion of the strip that has passed through and is distal to the loop forming interconnection, wherein the loop forming interconnection releasably secures the elongated length of the carrier strip such that the strip may be secured within the loop forming interconnection anywhere along its elongated length or released to move lengthwise through the loop forming interconnection such that the circumference of the loop and the length of the tail formed from the engagement between said loop forming interconnection and said elongated length of material may be adjusted;

interconnecting the two carrier strips along the circumference of the loops formed from the carrier strips with a loop interconnecting member configured to slidably engage the two carrier strips such that the point along the two carrier strips of the interconnection between the two carrier strips may be adjusted;

adjusting the circumference of each of the loops via the loop forming interconnections and the point at which the loop are interconnected via the loop interconnecting member to accommodate the body of a user; and wherein the length of the carrier strips is chosen such that the tails formed from the strips are sufficiently long to allow each of the tails to wrap at least halfway about the circumference of the body of the user.

In one such embodiment, the length of the carrier strips is chosen such that the tails formed from the strips are sufficiently long to allow each of the tails to wrap at least half-way about the circumference of the body of the user, the method further comprising wrapping the tails about the circumference of the user's body and knotting the ends of the tails to securely interconnect them.

In another such embodiment, the carrier strips are made from a material selected from the group consisting of textiles and plastics.

In still another such embodiment, the carrier strips are made from a natural or synthetic textile formed by a method selected from the group consisting of weaving, knitting, pressing and felting.

In yet another such embodiment, the loop forming interconnection is a pair of rings.

In still yet another such embodiment, the loop interconnecting member interconnects the two strips at an approximately vertically opposite angle.

In still yet another such embodiment, the loop interconnecting member is selected from the group consisting of a bisected circular or polygonical ring formed of a rigid material, a loop of flexible or rigid material, and a square of flexible or rigid material having two bisecting passages, the passages set at a vertically opposite angle from each other.

In still yet another such embodiment, the loop interconnecting member further comprises an adjustment pull attached thereto.

In still yet another such embodiment, the strips are sufficiently long to allow each of the tails to wrap completely about the circumference of the body of the user.

In still yet another such embodiment, the carrier is configured such that the baby or small animal is positioned vertically on the front of the user's torso facing the same direction as the user, vertically on the front of the user's torso facing inward toward the user's torso, vertically on the user's back facing toward the user's back, fully or partially cradled, and against the user's hip.

BRIEF DESCRIPTION OF THE DRAWINGS

These and other features and advantages of the present invention will be better understood by reference to the following detailed description when considered in conjunction with the accompanying figures, wherein.

DETAILED DESCRIPTION OF THE INVENTION

The present invention is directed to a carrier to be worn by multiple parents or caregivers, which may be used to carry children and small to medium sized animals. The construction and method of using the carrier are major improvements over conventional means of carrying and transporting children and animals. More specifically, the carrier is designed to hold a child or animal in a variety of positions from birth to approximately 40 pounds. It may also accommodate tandem baby-wearing by using each loop for one child and then tying the excess fabric around both children's bodies and the user's waist.

The carrier of the instant invention is a novel cross between a traditional wrap and an adjustable ring sling with an additional adjustable connecting device at the user's back. In broad terms the carrier is constructed of two adjustable loops of fabric coupled by a connecting device at the user's back. The carrier has the advantage of being able to operate in a variety of positions as with a traditional wrap, and the convenience of an adjustable ring sling that can accommodate a wide-range of user sizes without the disadvantage of disassembling the carrier completely for each user.

Figure 1:
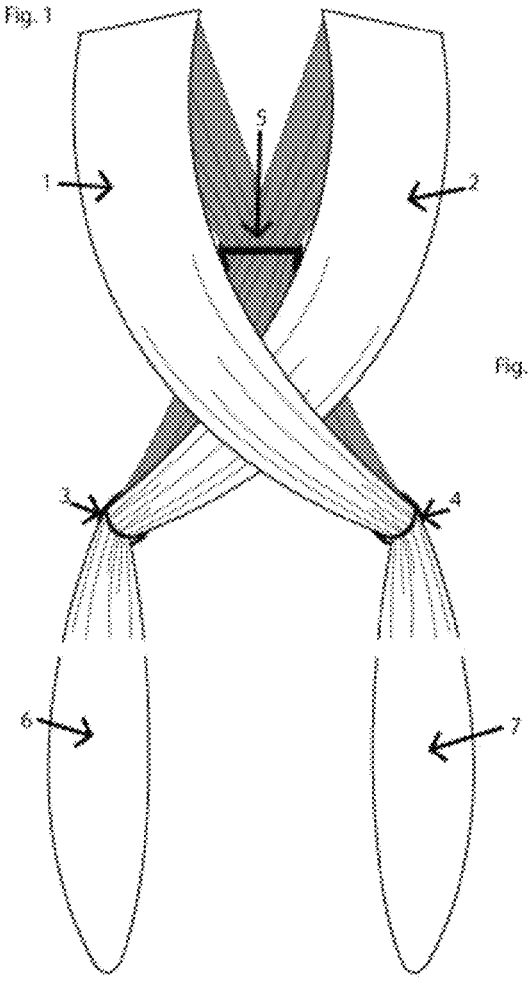
FIG. 1 shows a front view of an embodiment of the baby carrier in accordance with the current invention.
Figure 2:
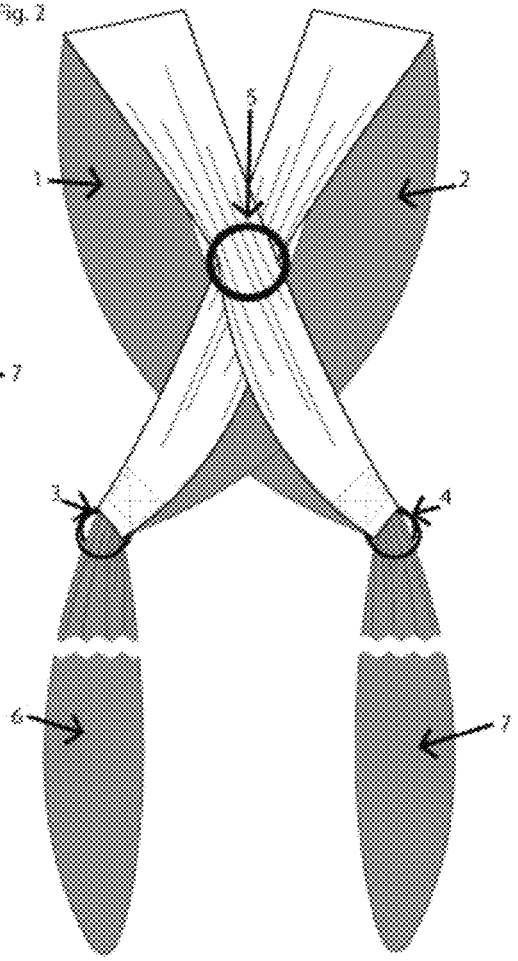
FIG. 2 shows a back view of an embodiment of the baby carrier in accordance with the current invention.
Figure 3:
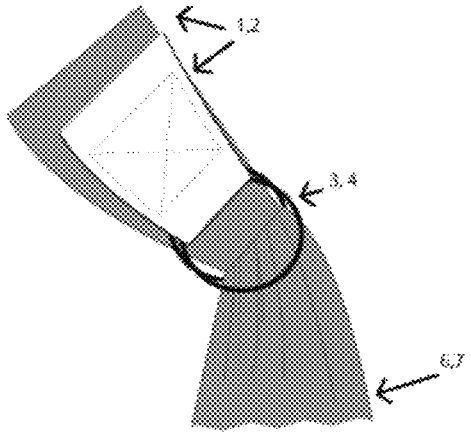
FIG. 3 shows a detail view of an embodiment of the baby carrier in accordance with the current invention.
Figure 4:
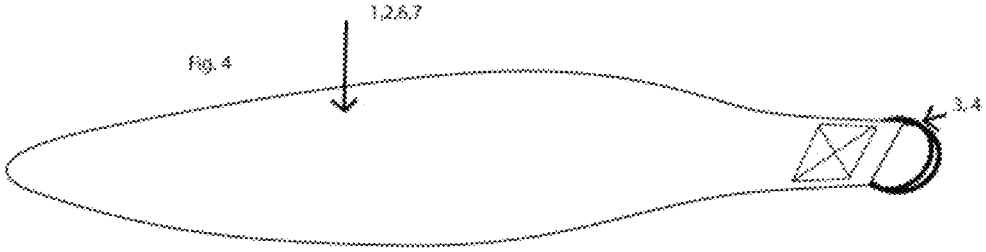
FIG. 4 shows another detail view of an embodiment of the baby carrier in accordance with the current invention.

As shown in detail in FIGS. 1 to 11, the carrier consists of two elongated pieces or strips of material, (1 & 2) (FIGS. 1 & 4). It should be understood that these strips could be formed of any suitable material, either natural or synthetic, including plastics and textiles/fabrics. These materials may be of any weave, and may have any properties suitable for use in a carrier, including sheen, color, resilience, etc. Moreover, these materials may be formed by any suitable method including, for example, weaving, knitting, pressing and felting.

Each elongated piece has a loop forming interconnection device attached on one end thereof (3 & 4) (FIGS. 1 & 4). Although this loop forming interconnection can take any form that allows the opposite end of the elongated piece to be woven and secured therethrough, in some embodiments the interconnection device preferably comprises a set of circular rings. During use, the end opposite the loop forming interconnection device is threaded through the interconnection device (as shown in FIG. 3) thereby creating an adjustable loop (1 & 2) proximal to the interconnection, and a tail of fabric (6 & 7) distal to the interconnection that is used to wrap around the baby/animal and the user. Preferably, the fabric is configured to be wide and long enough so that the tail (6 & 7) can be used together to wrap about the baby/animal and further secure the baby/animal by wrapping at least partially about the circumference of the user's body, and more preferably each of the tails would be long enough to wrap completely about the circumference of the user's body.

As will be understood, because the size of the loops (1 & 2) are fully adjustable by sliding increasing or reducing the length of the tail of material (6 & 7) threaded through the interconnection device (3 & 4), it is possible to instantaneously adjust the size of the loops to conform to the frame of the user and the baby/animal being carried without unwrapping or deconstructing the loops in any way. In other words, once the loops have been formed, the operation of the carrier does not require the deconstruction of the carrier unless desired by the user for maintenance or cleaning.

Figure 6:
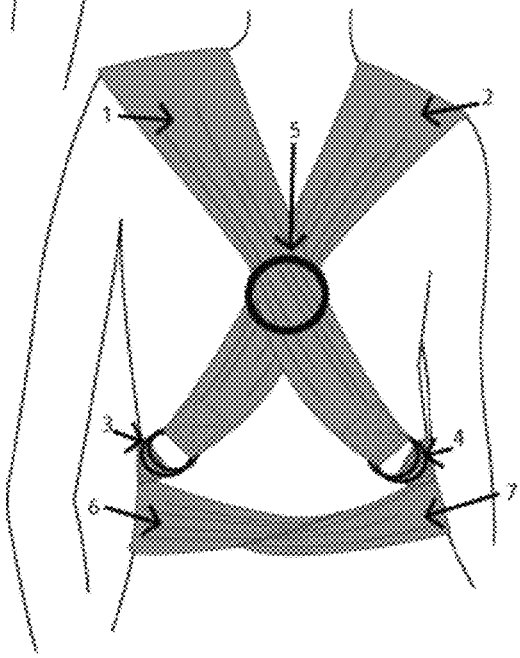
FIG. 6 shows a back view of an embodiment of the baby carrier in use in accordance with the current invention.
Figure 7:
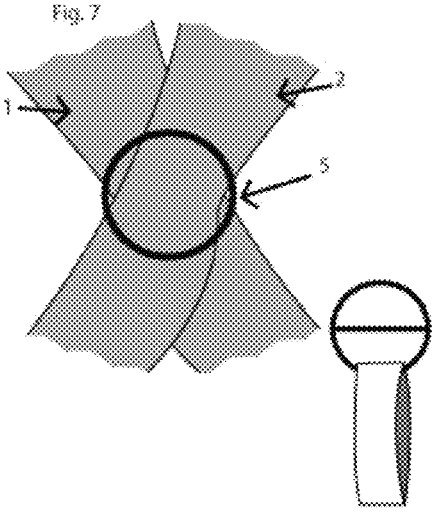
FIG. 7 shows a detail view of an embodiment of the baby carrier in accordance with the current invention.
Figure 8:
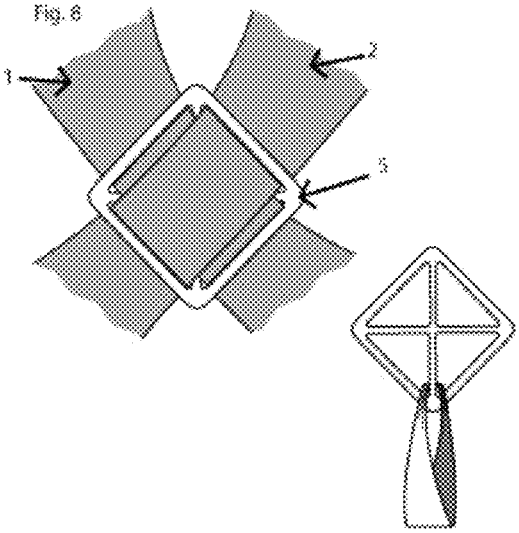
FIG. 8 shows another detail view of an embodiment of the baby carrier in accordance with the current invention.
Figure 9:
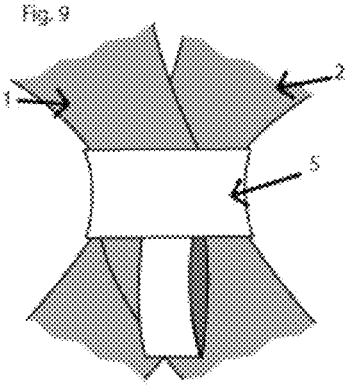
FIG. 9 shows still another detail view of an embodiment of the baby carrier in accordance with the current invention.
Figure 10:
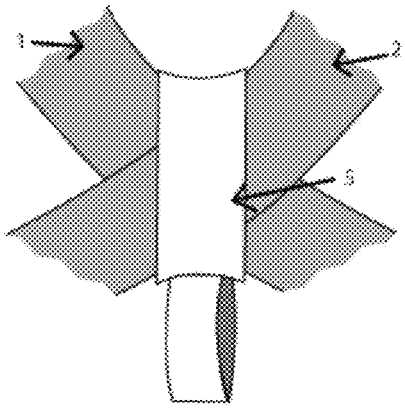
FIG. 10 shows yet another detail view of an embodiment of the baby carrier in accordance with the current invention.

Each loop thus formed is then interconnected together at the user's back by a moveable, sliding loop interconnecting device, (5) (FIGS. 2 and 6). As shown in FIGS. 7-10 this loop interconnecting device may take any form capable of adjustably interconnecting the two loops formed from the elongated pieces, such as, for example, bisected rings or rectangular crosses of metal, plastic or fabric with or without an adjustment pull device (8) (FIGS. 9-11). Preferably the two loops are held at an approximately vertically opposite angle, such that the loops form an "X" shape. It will be understood by an examination of the carrier, that this loop interconnecting device allows a second degree of freedom in adjusting the position of the loops. In particular, this loop interconnecting device allows the where and how the loops, and thus the weight of the baby/animal, fall on the users back. As a result, this loop interconnecting device allows for the position and configuration of the loops to be adjusted in accordance with the user's stature, and also provides comfort and support for the user because the weight of the child or animal can be evenly distributed on the user's back. Moreover, this adjustment can again be made during use, without deconstructing the carrier.

Figure 5:
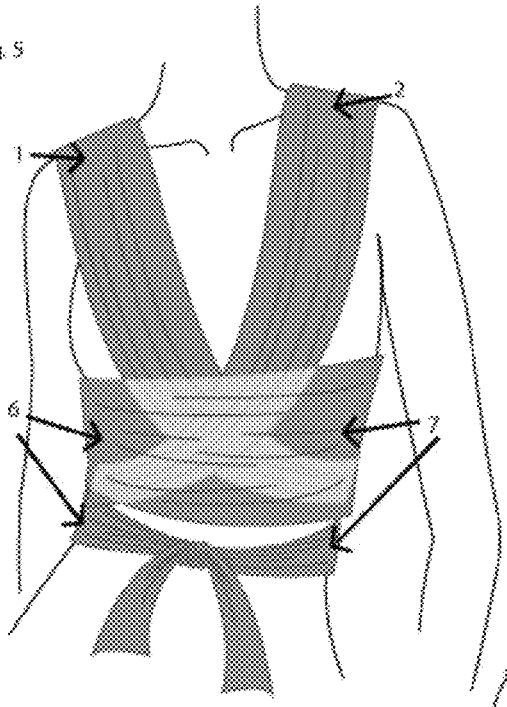
FIG. 5 shows a front view of an embodiment of the baby carrier in use in accordance with the current invention.

During use, once the elongated pieces of material (1 & 2) (FIG. 3) are separately formed into loops by threading/weaving them through the interconnection devices at the end of each strip of elongated material (3 & 4) (FIG. 3), the user then places each loop over one shoulder and underneath the opposite arm. For most carrying positions the loops are positioned such that they overlap to form an "X" in the front and back of the user's torso, as shown in FIGS. 5 & 6. The interconnecting ring device (5) can then be put into position to allow the overlap of the "X" of the straps, and the relative position of the loops, to be adjusted as desired by the user.

Although the above discussion focuses on a front carrying position, it should be understood that the carrier of the instant invention might be adjusted to carry in a number of different configurations. Generally speaking, the method of carrying the child or animal involves wearing the threaded loops in a variety of positions. In certain positions the child is carried vertically on the front of the user's torso and either faces the same direction as the user or faces inward toward the user's torso; or the child is carried vertically on the user's back facing toward the user's back. In other positions, a child or animal can be fully or partially cradled in the loops. In another position the child or animal is slung in the loops and carried against the user's hip or at the front of the user's torso.

Regardless of the configuration or position chosen by the user the general operation of the device is unchanged. The interconnection devices at the end of the elongated pieces allow for the size of the loops to be instantaneously adjusted to the desired length (either to conform to the size of the user or to conform to the necessary geometry of the carrying position) without deconstructing the carrier. Likewise, the loop connecting device allows the user to adjust the position of the loops for comfort and back support. In addition, the tails are used to provide additional support for the user and security for the child.

For example, one popular position is the hip carrying position, where the child/animal instead of being position directly in front or behind the user is positioned to one side. In this position, one or both loops would be worn over one or both shoulders and underneath the opposite arms. In all positions the remaining fabric tails would then wrap around the baby's body and the user's waist, providing security for the baby and extra support for the user. The various interconnection devices could then be used to adjust the length of the loops and relative positions of the loops with respect to the users shoulders and hips.

DOCTRINE OF EQUIVALENTS

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

What is claimed is:

1. A carrier for babies and small animals configured to be worn by a user, the carrier comprising:

two carrier strips, each formed from a continuous longitudinally elongated length of material having a first terminal end and a second terminal end, the second terminal end having a loop forming interconnection disposed thereon, wherein the first terminal end of each strip engages with and passes through the loop forming interconnection of its respective strip's second terminal end such that each strip forms a loop defined by the portion of the strip proximal to the loop forming interconnection and a tail of material defined by the portion of the strip that has passed through and is distal to the loop forming interconnection;

a loop interconnecting member configured to slidably interconnect the two carrier strips along the circumference of the loops formed from the carrier strips such that the loops interconnected together form an adjustable carrier position adapted to support one of either a baby or a small animal;

wherein the loop forming interconnection releasably secures the elongated length of the carrier strip such that the strip may be secured within the loop forming interconnection anywhere along its elongated length or released to move lengthwise through the loop forming interconnection such that the circumference of the loop and the length of the tail formed from the engagement between said loop forming interconnection and said elongated length of material may be adjusted;

wherein the loop interconnecting member releasably secures the two carrier strips together such that the point along the two carrier strips of the interconnection between the two carrier strips may be adjusted; and wherein the carrier strips are adapted such that the tails formed from the strips wrap at least half-way about the circumference of the body of the user.

2. The carrier of claim 1, wherein the carrier strips are made from a material selected from the group consisting of textiles and plastics.

3. The carrier of claim 1, wherein the carrier strips are made from a natural or synthetic textile formed by a method selected from the group consisting of weaving, knitting, pressing and felting.

4. The carrier of claim 1, wherein the loop forming interconnection is a pair of rings.

5. The carrier of claim 1, wherein the loop interconnecting member interconnects the two strips at an approximately vertically opposite angle.

6. The carrier of claim 1, wherein the loop interconnecting member is selected from the group consisting of a bisected circular or polygonical ring formed of a rigid material.

7. The carrier of claim 1, wherein the loop interconnecting member is a loop of flexible or rigid material.

8. The carrier of claim 1, wherein the loop interconnecting member is a square of flexible or rigid material having two bisecting passages, the passages set at a vertically opposite angle from each other.

9. The carrier of claim 1, wherein the loop interconnecting member further comprises an adjustment pull attached thereto.

10. The carrier of claim 1, wherein the strips are adapted to be sufficiently long to allow each of the tails to wrap completely about the circumference of the body of the user.

11. A method of carrying a baby or small animal using a wearable carrier comprising:

providing two carrier strips, each formed from a continuous longitudinally elongated length of material having a first terminal end and a second terminal end, the second terminal end having a loop forming interconnection disposed thereon;

passing the first terminal end of each strip through the loop forming interconnection of its respective strip's second terminal end such that each strip forms a loop defined by the portion of the strip proximal to the loop forming interconnection and a tail of material defined by the portion of the strip that has passed through and is distal to the loop forming interconnection, wherein the loop forming interconnection releasably secures the elongated length of the carrier strip such that the strip may be secured within the loop forming interconnection anywhere along its elongated length or released to move lengthwise through the loop forming interconnection such that the circumference of the loop and the length of the tail formed from the engagement between said loop forming interconnection and said elongated length of material may be adjusted;

interconnecting the two carrier strips along the circumference of the loops formed from the carrier strips with a loop interconnecting member configured to slidably engage the two carrier strips such that the point along the two carrier strips of the interconnection between the two carrier strips may be adjusted strips and such that the loops interconnected together form an adjustable carrier position adapted to support one of either a baby or a small animal;

adjusting the circumference of each of the loops via the loop forming interconnections and the point at which the loop are interconnected via the loop interconnecting member to accommodate the body of a user;

disposing one of either a baby or small animal within the carrier position; and wrapping the tails formed from the strips at least half-way about the circumference of the body of the user.

12. The method of claim 11, the method further comprising wrapping the tails fully about the circumference of the user's body and knotting the ends of the tails to securely interconnect them.

13. The method of claim 11, wherein the carrier strips are made from a material selected from the group consisting of textiles and plastics.

14. The method of claim 11, wherein the carrier strips are made from a natural or synthetic textile formed by a method selected from the group consisting of weaving, knitting, pressing and felting.

15. The method of claim 11, wherein the loop forming interconnection is a pair of rings.

16. The method of claim 11, wherein the loop interconnecting member interconnects the two strips at an approximately vertically opposite angle.

17. The method of claim 11, wherein the loop interconnecting member is selected from the group consisting of a bisected circular or polygonical ring formed of a rigid material, a loop of flexible or rigid material, and a square of flexible or rigid material having two bisecting passages, the passages set at a vertically opposite angle from each other.

18. The method of claim 11, wherein the loop interconnecting member further comprises an adjustment pull attached thereto.

19. The method of claim 11, wherein the strips are adapted to be sufficiently long to allow each of the tails to wrap about the circumference of the body of the user and the one of either baby or small animal disposed within the carrier position.

20. The method of claim 11, wherein the carrier position is configured such that the baby or small animal is disposed in accordance with one of the following vertically on the front of the user's torso facing the same direction as the user, vertically on the front of the user's torso facing inward toward the user's torso, vertically on the user's back facing toward the user's back, fully or partially cradled, or against the user's hip.

* * * * *